United States Patent [19]

Brandstätter et al.

[11] 3,969,980

[45] July 20, 1976

[54] MACHINE GUN

[75] Inventors: Hubertus Brandstätter; Oswald Tschöll, both of Kufstein, Austria

[73] Assignee: American International Corporation, Salt Lake City, Utah

[22] Filed: Apr. 12, 1974

[21] Appl. No.: 460,601

[52] U.S. Cl. ..... 89/33 D; 42/1 S; 42/71 R; 42/75 C; 89/1 K

[51] Int. Cl.[2] ..... F41C 25/10

[58] Field of Search ..... 89/33 R, 33 D, 33 MC, 89/33 A, 33 B, 33 BA, 33 BB, 33 BC, 33 C, 33 CA

[56] References Cited

UNITED STATES PATENTS

| | | | |
|---|---|---|---|
| 1,462,852 | 7/1923 | Dawson et al. | 89/33 D |
| 2,112,660 | 3/1938 | Hudson | 89/33 B |
| 2,627,208 | 2/1953 | Simpson | 89/33 C |
| 2,820,401 | 1/1958 | Gerick | 89/33 CA |

*Primary Examiner*—Stephen C. Bentley
*Attorney, Agent, or Firm*—Emory L. Groff, Jr.

[57] ABSTRACT

A machine gun includes a feed block removably mounted intermediate a cartridge magazine and the gun receiver and which is provided with self-contained movable flange members adapted to support the lowestmost cartridge being delivered to the feed block yet which flange members yield to the force of the closing gun bolt as the bolt strips the cartridge from its captive position within the feed block and guides it into the chamber. The gun shoulder stock, receiver, receiver cover and feed block are constructed in a manner to facilitate instantaneous field disassembly of these components without the need for any tools while a bolt operating handle is provided which is of the free floating type, i.e. does not reciprocate during continuous firing of the gun.

12 Claims, 13 Drawing Figures

1
2
3
4
5
6
6
7
8
15
16
16
17
18
22
24
26
28
50
70
76
85
92
99
100
T 8
9
12
12
16
21
23
62
C 24
25
31
38
38
43
43
57
C 24
25
31
31a
38
39
39
43
43
57
C 4
89
93a
94
96
95
97
87
88
98
90
92
111
85
86
60
61
58
59
108
112
105
106
17
22
107
1
16
52
6
36
8
12
9
57
62
21
61a 40
41
44
63
48
42
39
24
37
31
30
31a
45
46
38
25
47
49
27

33
37
32
34
30
31
24
38
35
25
29

FIG. 11.
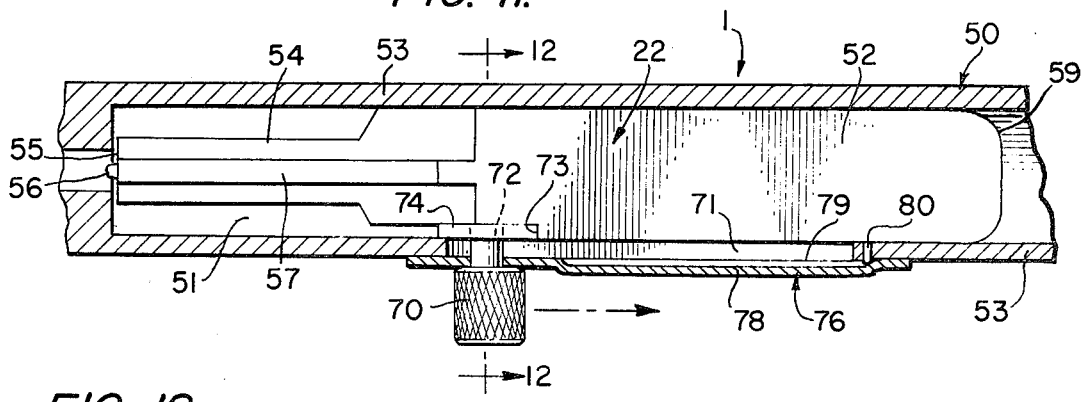
FIG. 12.
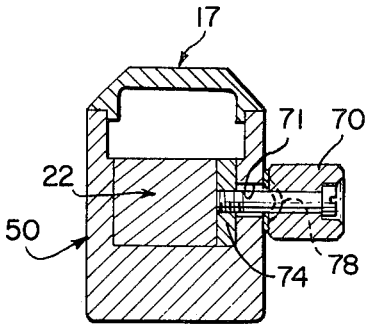
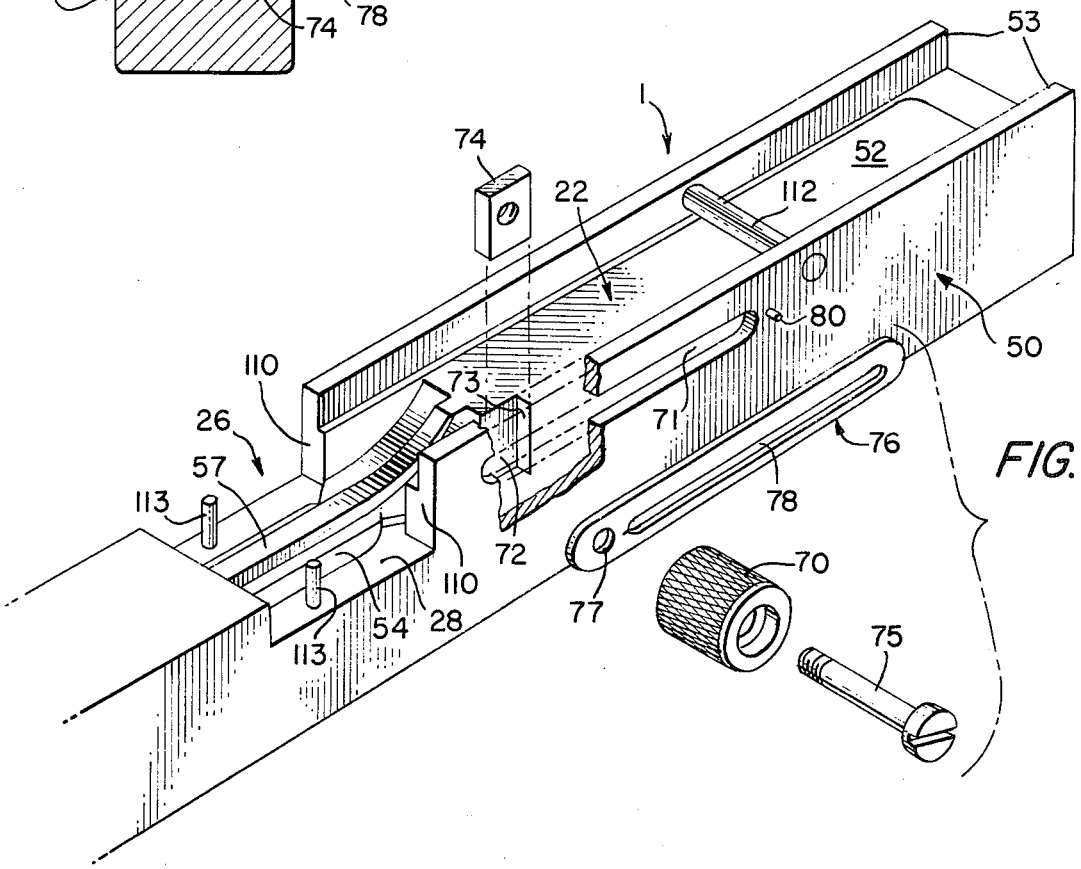
FIG. 13.

MACHINE GUN

This invention relates generally to guns of the automatic firing type, and more particularly, to an improved machine gun of a significantly simplified, yet reliable, construction.

The heart of an automatic weapon may be considered to involve the feeding mechanism that is provided to receive, guide and deliver the cartridges to the chamber of the gun. With the realization that automatic weapons employ an extremely high firing rate, it will be appreciated that reliable means must be included to insure the rapid and accurate guidance or feeding of the cartridges from the cartridge magazine means to the weapon's firing chamber, which feeding means must necessarily be resistant to jamming, either by the cartridges themselves or by any foreign material, such as dirt, sand, or extraneous particles which may find their way into the mechanism. Accordingly, many prior known automatic weapons have employed large, cumbersome, levers and cams for controlling the feeding and directing of cartridges from a magazine into the gun chamber, such structure often inducing unwanted additional vibration during operation of the gun, while still being subject to jamming by foreign particles and also substantially increasing the necessary bulk of the weapon's receiver, all of which noticeably increase the cost of manufacture and maintenance thereof.

An example of a prior known mechanism will be found in U.S. Pat. No. 3,366,010, issued Jan. 30, 1968, which illustrates cartridge feeding and directing means comprising an oscillating bullet guide arm or lever mounted in a machine gun receiver and which contains cam portions alternately struck by the reciprocating bolt during operation of the gun. By the present invention, an improved feed block is provided comprising an integral sub-assembly adapted to receive, retain in a partially elevated position and to subsequently release sequentially expended cartridges upon each operational movement of a machine gun bolt which in turn is operated by the recoil or blow-pack principle. The retention of each cartridge as it is delivered to the feed block is achieved by means of a pair of spring-urged flange members capable of resisting the force applied to each cartridge by the driving means of the particular cartridge magazine supply system, yet capable of yielding to the forward and downward movement of the cartridge by means of a forwardly moving bolt as it engages the rear face or base of the cartridge.

In the earlier patent referenced above, the weapon is initially readied for firing by cocking the bolt rearwardly against the force of a bolt spring. This movement is made by drawing rearwardly upon a bolt handle forming an integral part of the bolt, and accordingly it will be appreciated that when the weapon trigger is squeezed and the gun is operated, this bolt handle will reciprocate along with the bolt during operation of the gun. The disadvantages of such an arrangement will be readily appreciated. Danger is always inherent in a rapidly reciprocating member projecting from a gun during its use, while the opening which must be provided in the receiver to allow movement of this thus described bolt also serves an ingress for dirt and other foreign particles, leading to the possibility of jamming. In the present structure, a floating or freely-mounted bolt operating handle passes through a slot in the gun receiver and includes an actuating member on an interior extension thereof which engages a portion of the bolt only during the initial cocking action of the weapon. Subsequently, the bolt handle may be moved forwardly to an at-rest position or, if left alone in the cocked position, will be automatically moved to the forward at-rest position the instant the weapon's trigger is squeezed, such that there will be no further reciprocation of the bolt handle during continuous firing of the gun. Means are associated with this bolt handle to serve as a dust cover overlying the required longitudinal slot in the receiver when the bolt handle is in the described forward rest position.

Many earlier machine guns were quite unwieldy to transport in view of the massive size thereof and field stripping of the weapon was usually difficult and at best involved the use of tools and in many cases required a readjustment procedure following subsequent reassembly of the components. With the instant structure, the shoulder stock, feed block and a receiver cover may all be disassembled without the use of any tools, even a coin or a fingernail, in view of the unique construction of the concerned mechanism which must be actuated in a prescribed sequence in order to permit the removal of these components, all of which may be achieved in less than five seconds time.

Accordingly, one of the objects of the present invention is to provide an improved machine gun having unique means for receiving, retaining, and directing or feeding in a sequential manner, cartridges from an appropriate magazine system to the weapon chamber, which feed means comprises an integral sub-assembly instantly attached or removed from the remainder of the gun.

Another object of the present invention is to provide an improved machine gun including a feed block removably attached above and immediately rearward of the gun chamber and provided with a central longitudinal cartridge throat through which individual cartridges are delivered and including support means below the rear portion of the throat for engaging the rim of the cartridge and a pair of outwardly displaceable flange lips below the forward portion of the cartridge throat for yieldingly supporting the forward portion of the cartridge, which flange lips resist the downward pressure of subsequent cartridges, yet yield to the force of the weapon's bolt as it engages the rim of the cartridge during the next closing stroke.

Still another object of the present invention is to provide an improved machine gun having a feed block disposed immediately beneath the discharge portion of a cartridge magazine and immediately above and rearwardly of a weapon chamber, which feed block includes displaceable flange means supporting the forward portion of each cartridge as it is initially admitted to the feed block, but which subsequently yields as the cartridge contained therein is driven forwardly by a closing bolt and the nose of the cartridge is directed downwardly toward the chamber by a tapered nose guide portion in the forward area of the feed block.

A further object of the present invention is to provide an improved machine gun of the recoil/blow-back operated type including a floating bolt handle freely slidable through a slot in the weapon's receiver and engageable with the bolt solely during the initial cycle of the bolt's operation and which subsequently remains in a forward at-rest position during reciprocation of the bolt as the weapon is fired.

A further object of the present invention is to provide an improved machine gun having unique means for attachment of a cartridge feeding and guiding block, cover and shoulder stock to the weapon's receiver, which attachment and removal thereof is accomplished without the use of any tools and only if performed in a particular sequence.

With these and other objects in view, which will more readily appear as the nature of the invention is better understood, the invention consists in the novel construction, combination and arrangement of parts hereinafter more fully described, illustrated and claimed.

IN THE DRAWINGS:

FIG. 11 is a fragmentary horizontal sectional view and illustrates the bolt and bolt actuating handle of the present invention;

FIG. 12 is a transverse sectional view taken along the line 12—12 of FIG. 11;

FIG. 13 is an enlarged partial perspective view of the structure of FIG. 11, with portions shown in exploded positions for clarity.

Similar reference characters designate corresponding parts throughout the several figures of the drawings.

Figure 1:
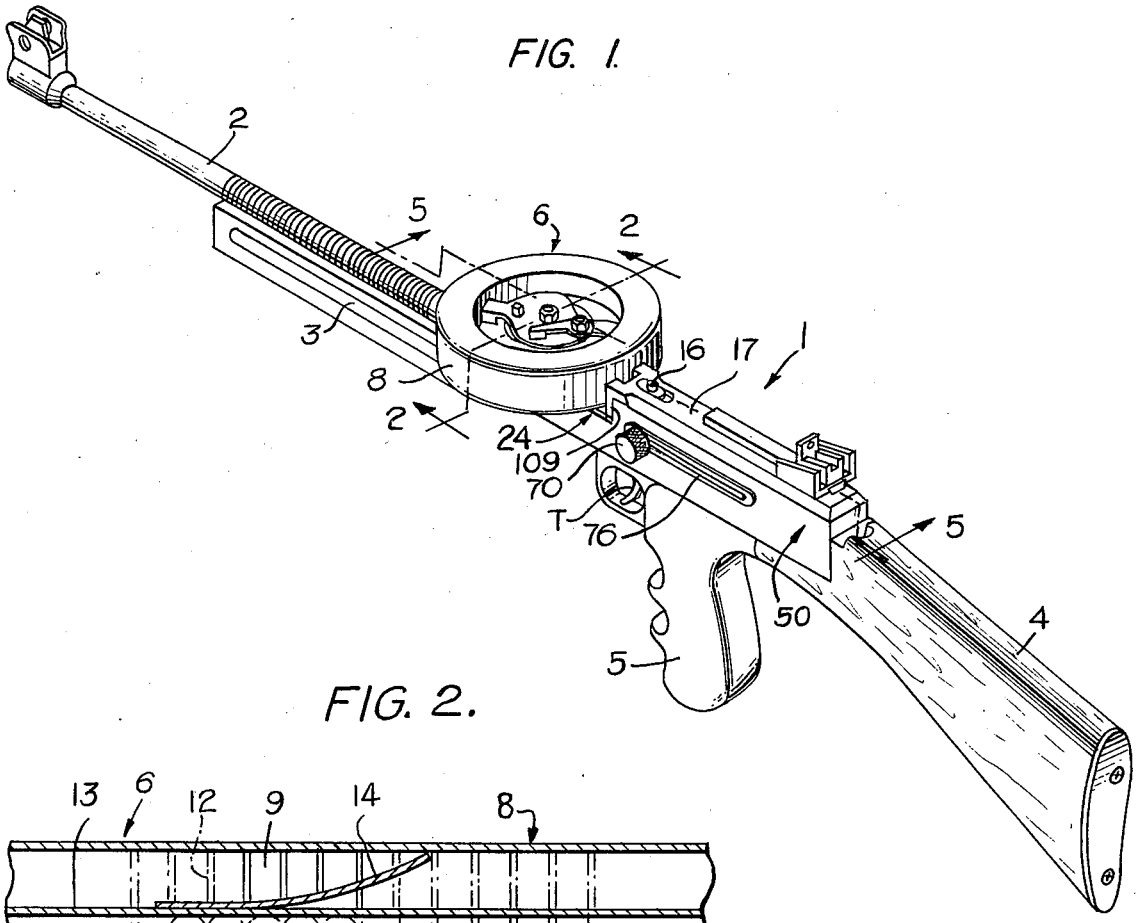
FIG. 1 is a perspective view of a machine gun according to the present invention.
Figure 4:
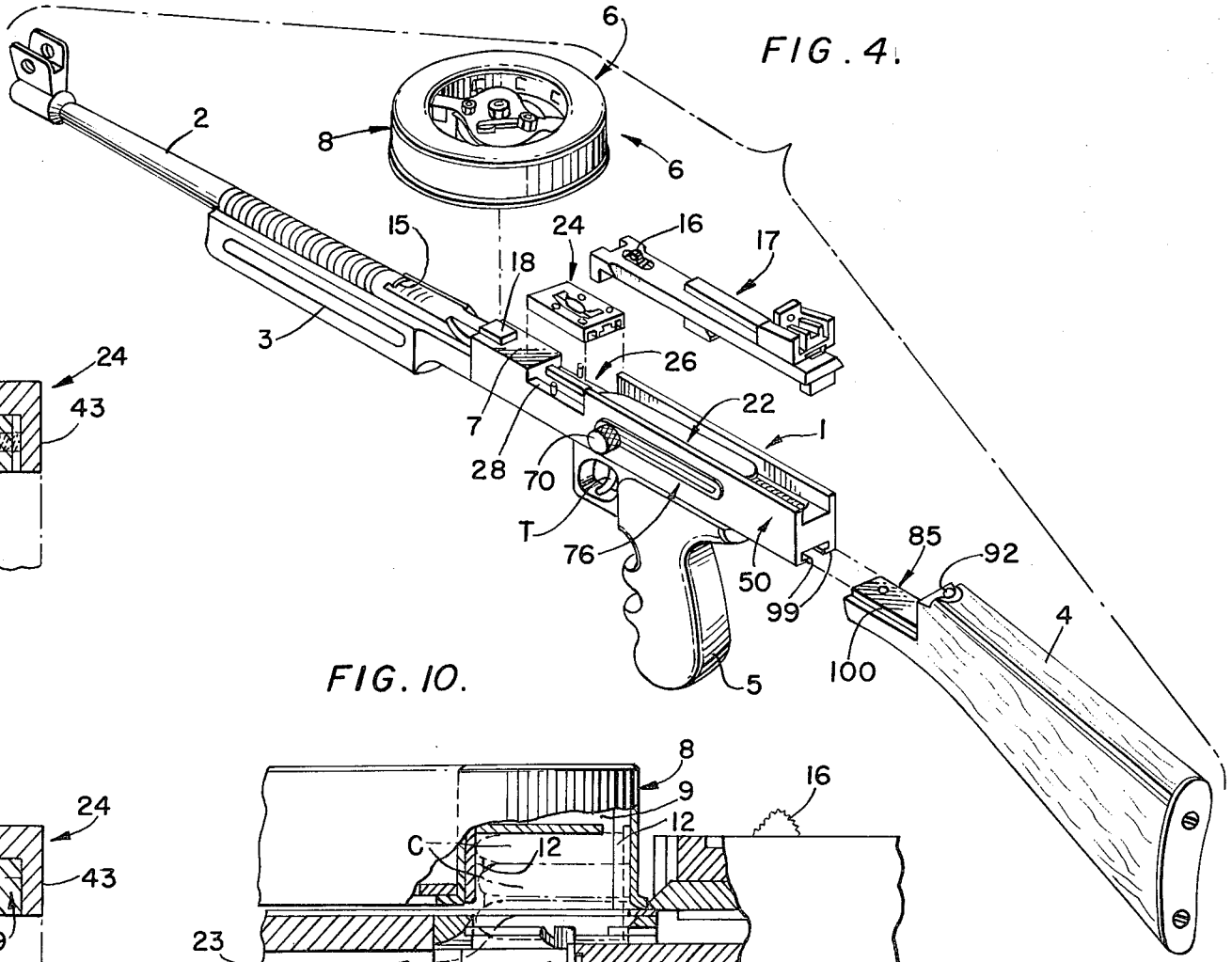
FIG. 4 is an exploded perspective view of certain of the components as shown in FIG. 1.
Figure 10:
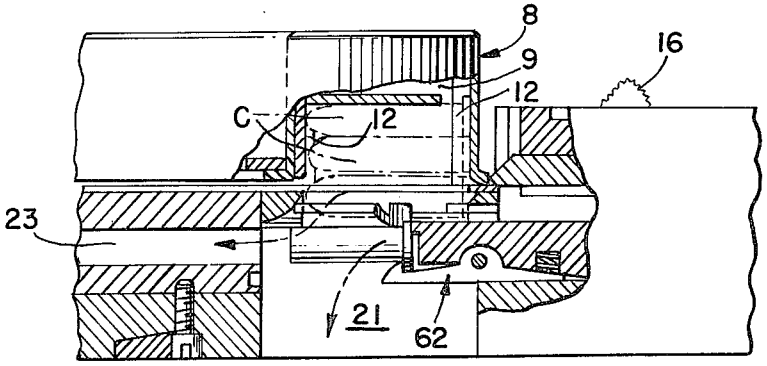
FIG. 10 is a view similar to FIG. 3, but illustrates the position of the components as the bolt is recoiling in extracting a spent cartridge just prior to ejection.
Figure 8:
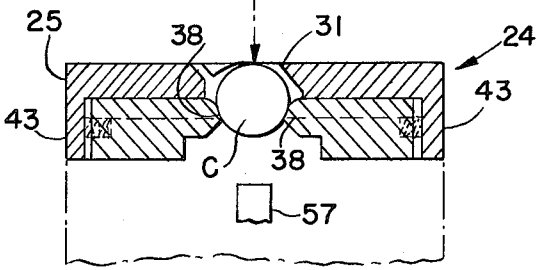
FIG. 8 is a transverse vertical sectional view through the feed block of the invention and illustrates the displaceable flange members as they appear when supporting a cartridge next in line to be fed into the weapon chamber.
Figure 9:
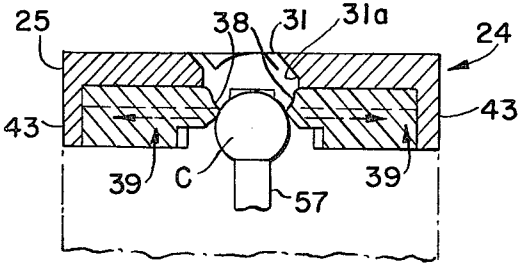
FIG. 9 is a view similar to FIG. 8, but illustrates the position of the displaceable flange members as the cartridge of FIG. 8 is being driven and guided forwardly into the weapon's chamber by the forward movement of the bolt.

Referring now to the drawings, particularly FIGS. 1 and 4, the present invention will be seen to comprise an automatic weapon including, as basic components, a receiver generally designated 1, attached to the barrel 2 supporting a suitable forestock 3 while the receiver 1 supports the shoulder stock 4 and hand grip 5. A cartridge supply means such as the cartridge drum magazine 6 is adapted to be removably attached to a plane surface 7 formed on the subjacent upper surfaces of the receiver and barrel.

It will be appreciated that the present invention may be carried out in combination with any other suitable type of cartridge supply mechanism adapted to automatically and sequentially supply cartridges in a downward direction and under a substantially constant pressure. The illustrated drum magazine 6 includes an annular cover 8, of generally inverted U-shaped configuration, providing an internal cartridge storage cavity 9 overlying a magazine base plate 10 provided with a cartridge exit 11 adapted to be positioned above and adjacent the chamber of the receiver 1. Vertical ribs 12, on the inner and outer walls of the magazine cover 8 laterally separate cartridges C contained within the cover, while a follower ring 13 overlies the uppermost layer of cartridges and exerts a constant downward pressure by means of suitable spring members 14. The cartridge magazine may be readily attached to the machine gun by the provision of a notch 15 in the bararel 2 on the one hand, and a spring-urged slide release 16 on the forward portion of the receiver cover 17, which notch and slide release are adapted to cooperate with diametrically opposed portions of the periphery of the magazine base plate 10 following orientation of the magazine with the machine gun by means of a fixed upstanding post 18 on the plane surface 7 which engages a mating opening **19*a* formed in the center of the magazine base plate 10**.

Figure 2:
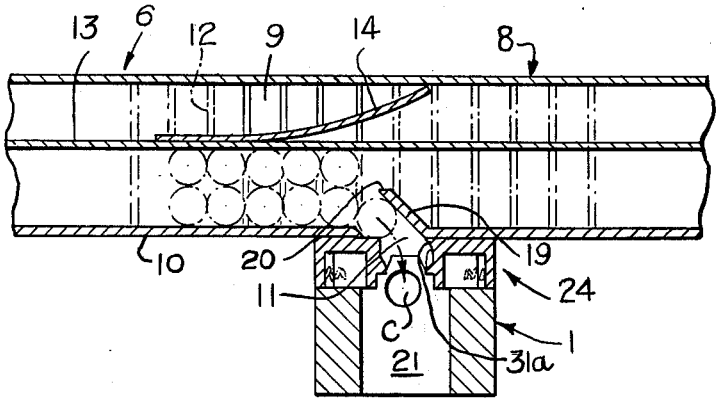
FIG. 2 is an enlarged, fragmentary cross-sectional view taken along the line 2—2 of FIG. 1.

In the illustrated cartridge drum magazine 6, the cover 8 containing the cartridges C is intended to be rotated in a counter-clockwise direction while the magazine base plate 10 remains fixedly attached at all times. This rotation of the cover may be provided by any suitable drive assembly such as the structure generally identified as 18 in FIGS. 1 and 4 of the drawings, and which will be understood to include any appropriate spring-driven mechanism capable of rotating the magazine cover when the weapon is operated so that the cartridges C will move in a direction from left to right as the structure is viewed in FIG. 2, whereupon the lowermost layer of cartridges will be sequentially advanced toward the upstanding inclined strip feed tongue 19 extending upwardly from the magazine base plate 10 immediately adjacent the cartridge exit 11 therein. The tongue 19 will be seen to include an upper distal tip portion 20 presenting a substantially flat surface parallel with the base plate 10 and disposed at an elevation no higher than the thickness of one cartridge so that, upon rotation of the magazine cover 8 and the cartridges laterally captivated therein by means of the ribs 12, the supply of cartridges will be sequentially stripped from the magazine in the manner illustrated in this figure of the drawings.

Figure 3:
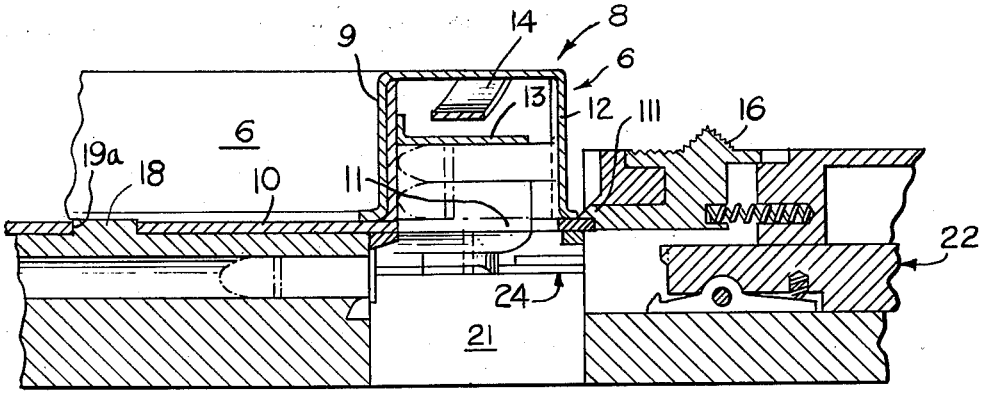
FIG. 3 is an enlarged longitudinal sectional view which illustrates the feed block and its relationship to the adjacent components of the weapon.

With the drive assembly 18 of the cartridge magazine 6 actuated, it will follow that a continuous stream of cartridges would be urged downwardly through the magazine's cartridge exit 11 and thence straight through the ejection port 21 of the receiver 1 were it not for specific means to regulate the movement of cartridges from the exit 11 and to provide guidance for proper registry with respect to the reciprocating bolt 22 for proper movement of the cartridge into the baarrel chamber 23. A superior integral sub-assembly is provided for the present machine gun for accomplishing this receiving, retaining, registering and proper advancement of each cartridge from the magazine exit 11 to the chamber 23. This structure comprises a feed block, generally designated 24, and which is shown most clearly in the enlarged views of FIGS. 6 and 7 of the drawings. The feed block 24 includes a main body 25 of rectangular configuration and adapted to be removably and snugly inserted within the notched area 26 formed in the receiver 1 immediately beneath the position occupied by the cartridge exit 11 of the magazine 6. When seated with the notched area 26, with the lower surface 27 of the feed block flush with the dropped receiver surface 28, the upper surface 29 of the feed block will be understood to be co-planar with the plane surface 7 of the receiver and thereby a close fit will exist between the bottom of the magazine base plate 10 and the upper surface 29 of the feed block, as illustrated most clearly in FIGS. 2 and 3 of the drawings.

Figure 6:
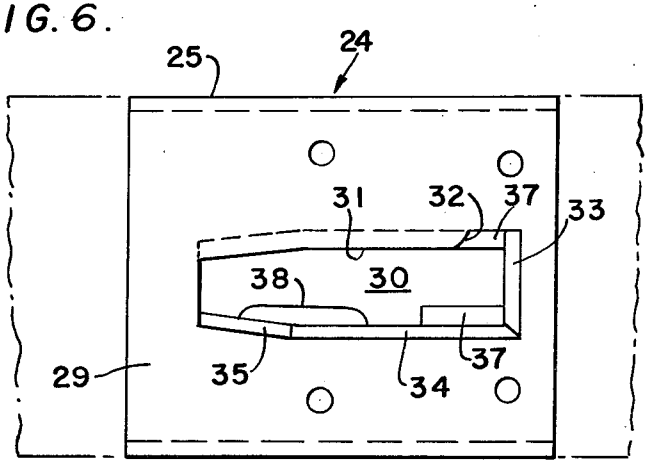
FIG. 6 is an enlarged top plan view of the feed block of the present invention.

Referring now to the top plan view of FIG. 6, it will be seen that the co-planar upper surface of the feed block is provided with a longitudinally extending cartridge throat 30 of a length and width no less than the corresponding dimensions of one of the cartridges C. The cartridge throat 30 is bounded along one side by means of a strip edge 31 having a rearmost distal portion 32 stopping short of the downwardly and inwardly beveled transverse rim 33 at the rear of the throat 30. As shown most clearly in FIG. 2, the undercut beveled surface 31*a* adjacent the strip edge 31 provides a smooth continuity with the juxtaposed surface of the feed tongue 19 of the attached cartridge drum magazine 6. This construction cooperates with the oppositely disposed downwardly and inwardly beveled edges 34 and 35 on the opposite side of the cartridge throat. The majority of this other side of the throat is bounded by a rear longitudinal bevel edge 34 adjacent the front canted bevel edge 35. With the foregoing in mind, it will be readily apparent that as cartridges C are urged downwardly into the throat 30, the inclination of the edges 31, 34, and 35 assists in the reception and passage of the cartridges, as they are angularly discharged through the cartridge drum magazine 6. The distal portion 32 of strip edge 31 is spaced forwardly of the transverse beveled rim 33 a distance significantly greater than the thickness of a cartridge rim 36 to permit passage of a cartridge through a throat 30. It will be understood that as each cartridge is urged into and through the throat 30, there will always be a constant pressure applied to its upper portion by the next succeeding cartridge thereabove which is being urged toward the cartridge exit 11 by means of the drive assembly 18 acting on the remaining cartridges contained within the magazine.

Figure 7:
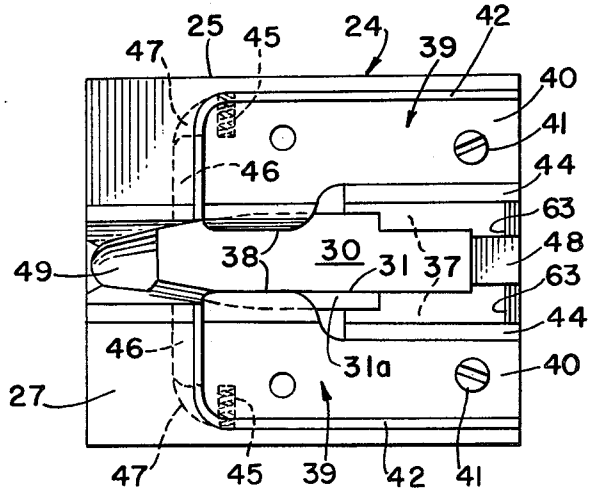
FIG. 7 is a bottom plan view of the feed block as shown in FIG. 6.

The downwward progression of each cartridge passing through the throat 30 is halted by two features contained in the feed block 24. The rim 36 of the cartridge rests upon and straddles the two laterally opposed rim ledges 37—37, which extend forwardly from the rear of the feed block body 25 a significant distance, as shown in FIG. 6. The medial and forward portion of the periphery of the cartridge comes to rest upon the inwardly projecting lips 38—38 of a pair of pivotally attached flange members 39, the bottom surfaces 40 of which are slightly offset above the plane of the main body lower surface 27 to preclude interference of the displacement thereof by the dropped receiver surfaces 28. Each of the flange members 39 is mounted for pivotal movement, as at 41, adjacent the rear portions thereof, and the majority of each flange member will be seen to be disposed within the recess 42 formed in the bottom of the main body 25, which recess is bounded on the lateral side thereof by means of the side wall 43 of the main body. The innermost portion of each recess 42 is bounded by a vertical rib 44 serving as a stop to limit the inward displacement of the flange member as caused by the compression spring 45, which will be understood to maintain a constant force upon the free ends of the flange members to normally maintain the inwardly projecting lips 38—38 within the confines of the cartridge throat 30, as shown in FIG. 7 of the drawings. Vertical stability and guidance is offered the distal portion of the two flange members by the forwardly extending tongue 46 disposed within the undercut areas 47 of the main body 25.

Additional important structure found in the feed block 24 and which serves to permit the subsequent feeding of each cartridge from the feed block into the weapon firing chamber includes a longitudinally extending rear slot 48 provided in the bottom portion of the feed block and communicating with the cartridge throat 30, while at the opposite or forward end of the feed block, there will be found a cartridge nose guide comprising a downwardly and forwardly directed tapered surface, the lowermost edge of which communicates with the top of the entrance to the barrel cartridge chamber 23.

Before describing the function of the feed block 24, certain cooperating structure of the machine gun must be understood. The receiver 1 includes a main body 50 provided with a longitudinally extending bolt channel 51 therein within which the bolt 22 is adapted to move in a reciprocating manner. The bolt includes a main body section 52 encompassing the majority of the overall length of the bolt and having a transverse dimension providing for a close sliding fit between the side walls 53—53 of the receiver, while the remaining forward portion of the bolt includes a head section 54 of substantially reduced transverse width and which contains the bolt face 55 having a suitable integral firing pin 56 projecting forwardly therefrom. As shown most clearly in FIG. 13 of the drawings, the head section 54 of the bolt is of substantially lesser height than the main body section 52 and contains a vertically extending rib 57 thereof of a transverse width no greater than the width of the rear slot 48 formed in the bottom of the feed block 24.

Figure 5:
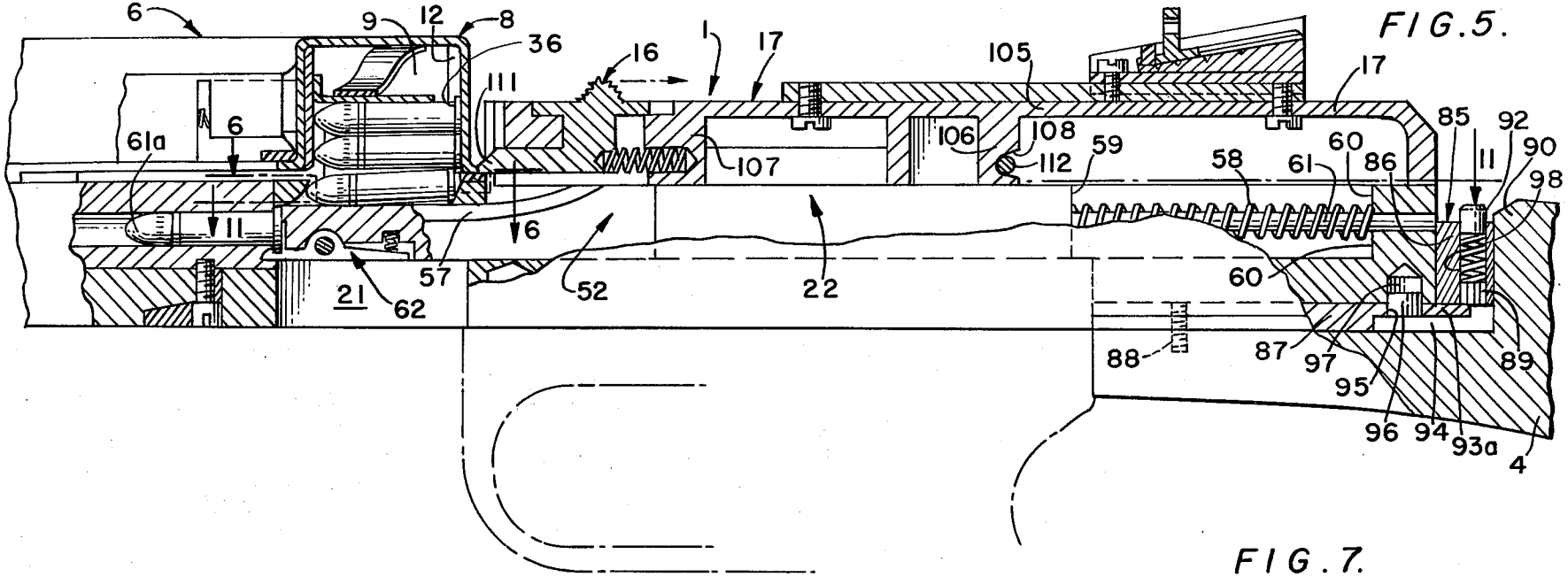
FIG. 5 is an enlarged longitudinal view, partly in section, taken along the line 5—5 of FIG. 1.

As previously explained, the machine gun of the present invention operates on the recoil or blow-back principle whereby detonation of a cartridge in the chamber not only propels the bullet thereof through the barrel, but also provides a recoiling force directed against the face of the bolt to drive the bolt rearwardly in the receiver. This rearward movement occurs against the force of the bolt spring 58, the forward portion of which constantly bears upon the rear 59 of the bolt, on the one hand, and against the rear surface 60 of the receiver on the other hand. A suitable spring support rod 61 maintains the bolt spring 58 in proper alignment, as shown in FIG. 5 of the drawings. The operation of the feed block 24 may be understood by reference to the structure shown in FIGS. 5 and 7 of the drawings. First, let us consider that the mechanism is as shown in FIG. 5, with the exception that there is no carriage C disposed within the chamber. Now, with a cartridge contained within the throat 30 of the feed block and resting upon the top of the bolt rib 57, it will be understood that in order to direct this carriage into the chamber, it is necessary to initially cock the bolt 22 rearwardly against the force of the spring 58. As the bolt is initially moved rearwardly and the face 55 passes from below the feed block 24, the cartridge within the throat 30 is urged downwardly to a position of rest, upon the two rim ledges 37—37 and the two inwardly projecting lips 38—38. Specific trigger and sear mechanisms have been purposely omitted from the drawings for reasons of clarity, it being understood that any suitable such structure may be used in combination with the present invention, such as the arrangement shown in the previously referenced U.S. Pat. No. 3,366,010. Accordingly, with the bolt 22 in the rearward cocked position and the spring 58 thereby under increased compression, it will follow that when the trigger T is squeezed, the bolt will be released and driven forwardly by the spring 58 toward the chamber 23. As the bolt face 55 approaches the lower portion of the feed block 24, the upstanding rib 57 on the head section 54 thereof passes through the rear slot 48 in the bottom of the feed block and engages the rim 36 of the cartridge which is resting upon the two ledges 37 and is disposed within the longitudinal path of the slot 48 and bolt/vertical rib 57. Continued forward progression of the bolt urges the cartridge contained within the feed block likewise in a forward direction with the rounded nose 61*a* of the cartridge engaging the uppermost portion of the tapered cartridge nose guide surface 49, and since this tapered surface is directed downwardly and forwardly toward the entrance to the cartridge chamber of the machine gun barrel, it will follow that the forward movement of the bolt will cause the cartridge to be guided into this chamber. The force as thus described overcomes the force of the springs 45 tending to maintain the flange members 39 in the position of FIG. 7, and the two inwardly projecting lips 38—38 thereof are urged outwardly as the body of the cartridge is pressed therebetween and below the horizontal plane of the projecting lips, at which time the springs 45—45 return the flange members to the normal at-rest position to halt any further movement of the next succeeding cartridge being urged downwardly by the action of the drive assembly 18 of the drum magazine 6. An important feature to observe is that the springs 45—45 acting upon the flange members 39 resist the pressure of the magazine drive assembly, yet yield to the pressure of the forwardly moving bolt engaging and driving the cartridge.

When the bolt has been driven to its forwardmost position, as in FIG. 5, with a cartridge C fully seated in the chamber, the resulting impact of the firing pin 56 upon the rim of the cartridge ignites the primer contained therein to produce firing of the cartridge projectile and the attendant recoil will return the bolt to the rearmost position against the force of the bolt spring 58. During this return movement, the spent cartridge case is extracted from the chamber by means of a suitable extractor/ejector 62 which may comprise a suitable pivoted element carried by the forward portion of the bolt, as shown in FIG. 5 of the drawings. The extractor is preferably mounted for pivotal movement upon the lower surface of the bolt head section 54 and cooperates with a pair of shoulders 63 on the bottom of the rear portion of the feed block, which shoulders straddle the rear slot 48 therebetween and serve as abutment means for the rim of the cartridge case during the rear movement of the bolt. Thus it will be apparent that as the extractor 62 draws the cartridge case rearwardly, the case will be urged downwardly away from the bolt face 55 when the upper portion of the rim strikes these fixed shoulders 63—63 with the casing being ejected downwardly through the ejection port 21. At the same time this ejection takes place, the lowermost cartridge C being urged downwardly by the cartridge drum magazine 6 will be understood to be in position and resting upon the feed block ledges 37—37 and flange member lips 38—38, thereby ready to be stripped from the feed block and driven into the barrel chamber in the manner already described, upon the return of the bolt to its forwardmost position.

The initial cocking of the bolt 52 to its rearmost ready position is accomplished by means of the bolt handle 70 located on one side of the receiver main body 50, as shown most clearly in FIGS. 1, 4, 11–13. Unlike many prior art devices wherein the bolt handle is rigidly affixed to the bolt itself and therefore reciprocates with each stroke of the bolt as the weapon is fired, the present bolt handle includes structure providing for an improved operation. One side wall 53 of the receiver is provided with a longitudinally extending slot 71 of a length sufficient to accommodate the movement of the bolt from its forwardmost to its rearwardmost extent.

One side side of the bolt main body section 52 at a point adjacent the head section 54 is provided with a side relief 72 bounded at the rear by a shoulder 73 and extending forwardly to provide unobstructed clearance toward the forward portion of the receiver. Slidably disposed within this side relief 72 is a bolt actuating block 74 forming an integral structure with the bolt handle 70 by means of a bolt handle attaching screw 75. Intermediate the bolt handle 70 and adjacent receiver side wall 53 is a longitudinally extending dust cover, generally designated 76, and which includes an aperture 77 at one end and a rib 78 extending from a point rearwardly of the aperture 77 to a point short of the opposite or rear end of the cover. This rib 78 projects outwardly from the dust cover to provide on the inner face thereof an internal longitudinal guideway 79 as shown most clearly in FIG. 11 of the drawings and cooperates with a guide pin 80 fixedly attached to and projecting outwardly from the side wall 53 at a point adjacent the rearmost limit of the slot 71.

With the above structure in mind, it will be seen that when the bolt handle 70 is moved rearwardly from the position shown in FIG. 11, the concurrent rearward movement of the actuating block 74 which is abutting the bolt forwardly-facing shoulder 73 will cause a corresponding rearward displacement of the bolt 22 until such time as the shank of the attaching screw 75 abuts the rearmost limit of the slot 71 and the guide pin 80 concurrently reaches the forwardmost limit of the guideway 79 within the rib 78. With the bolt thus in the cocked position, an appropriate sear lock (not shown) will act to retain the bolt thusly and the handle 70 may be moved to its forwardmost limit without any interference with the cocked bolt in view of the unobstructed clearance offered by the relief area 72 in a direction forward of the bolt shoulder 73. The gun is now ready for firing and as the bolt reciprocates during operation thereof, the bolt handle 70 and attached dust cover 76 remain in the forward or closed position of FIG. 11 to completely mask the longitudinal slot 71 through the receiver. To enhance the snug fit of the inner surface of the dust cover with the juxtaposed outer surface of the receiver side wall, the dust cover may be initially constructed to provide a slight convex curvature to the inner surface thereof in the area of the aperture 77 so that when finally assembled as in FIG. 11 of the drawings and the screw 75 and actuating block 74 are drawn together to provide a close sliding fit between the actuating block and the inner wall of the receiver side wall, it will follow that the cover will be flattened against the force of the pre-curved dust cover, thereby encouraging a firm sliding engagement between the dust cover and the exterior of the receiver.

To provide for rapid takedown of the principal components of the machine gun, a unique arrangement of cooperating structure is provided. For transporting a weapon, it would be quite obvious that if means were provided permitting ready removal of the shoulder stock 4 from the balance of the machine gun, the overall length thereof will be considerably foreshortened and accordingly, the forward portion of the shoulder stock 4 includes a right angular cutout area within which is disposed a mounting block, generally designated 85, including a vertically disposed receiver butt arm 86 joined to a horizontally extending receiver bottom plate 87. The mounting block 85 will be understood to be installed upon the shoulder stock 4 in a permanent manner and may be rigidly affixed thereto by means of a screw fastener 88 extending through the bottom plate 87 and into the forward portion of the stock while the butt arm 86 includes a rear sleeve 89 presenting a curved rear periphery which may be nestled within a corresponding cavity provided in the juxtaposed area of the shoulder stock. Additional rigidity is afforded the mounting block 85 by means of a forwardly extending nose 90 on the top of the shoulder stock adapted to overlie the top of the mounting block sleeve 89, as shown most clearly in FIG. 5 of the drawings. Carried within the vertically disposed bore 91 of the sleeve 89 is a shoulder stock release mechanism including a push button 92 having a shank 93 extending downwardly through the bore 91 and connected to a horizontal floor plate 93*a*, forward portion of which extends through the bottom recess 94 of the plate 87 to a point underlying an aperture 95 provided in the bottom plate 87. Slidably disposed through the aperture is a vertically extending lock pin 96 adapted to cooperate with a lock bore 97 formed in the bottom of the receiver main body 50.

The shoulder stock release mechanism is normally urged to the position as shown in FIG. 5 by means of a spring 98 tending to maintain the push button 92 in its uppermost position and therefore the lock pin 96 likewise in its uppermost position, thus retaining the shoulder stock 4 in the assembled position as shown in FIG. 5. Disassembly of the shoulder stock will therefore be understood to involve a simple manipulation of the push button 92 in a downward direction against the force of the spring 98 so that the floor plate 93*a* will be moved downwardly a corresponding distance to lower the lock pin 96 from within the confines of the receiver lock bore 97 whereupon the shoulder stock may be moved rearwardly and downwardly away from the receiver of the machine gun.

Positive alignment and retention means for insuring rigid attachment of the shoulder stock to the receiver is provided by the addition of the pair of inturned flanges 99 on the bottom of the receiver main body 50, as shown in FIG. 4, which flanges cooperate with mating grooves 100 formed in the side walls of the mounting block bottom plate 87.

Access to all of the operating components of the machine gun is readily achieved upon removal of the receiver cover 17, which action is possible without the use of tools of any nature. Removal of the receiver cover is necassary whenever it is desired to remove the feed block 24 from the machine gun, it being understood that mere removal of the magazine 6 is accomplished by actuation of the slide release 16.

The receiver main body 50 will be seen to provide a clear passageway between the upstanding portions of the two side walls 53—53 thereof. The receiver cover 17 is adapted to overlie and enclose the upper portion of the receiver main body as well as the openings at the rear and forward portions thereof. The top wall 105 of the receiver cover extends the width of the receiver main body and the length thereof from the rearmost portion to the notched area 26 and includes a depending central body section 106 forming a close sliding fit between the interior surface of the two receiver side walls 53—53 and extending downwardly to a point immediately short of the top surface of the main body section 52 of the bolt 22. Additional lateral stability is given to the receiver cover by means of a forward depending body section 107, likewise providing a close sliding fit with the receiver side walls. As will be apparent from a review of FIG. 5 of the drawings, the central body section 106 is located in a manner to insure that its lower surface will at all times be juxtaposed the main body section 52 of the bolt during its reciprocating travel. Formed in the rear of the central body section 106 is a rearwardly facing notch 108, the purpose of which will become apparent hereinafter.

Depending from the forward portion of the receiver cover 17 are a pair of vertically extending forward tongues 109—109 adapted to overlie the forwardly facing shoulders 110—110 of the main receiver body side walls adjacent the notched area 26 and the bottom portions of which are adapted to firmly engage the upper surface of the feed block when seated within the notched area 26. The operation of the previously mentioned slide release 16 as carried by the receiver cover will now be readily apparent. This slide release includes a forwardly extending lip 111 normally spring urged by means of the spring 112 engaging the forward body section 107 so that the lip 111 normally will overlie the flange of the magazine cover 8 which in turn rests upon the top surface of the feed block 24. From the foregoing, it will be apparent that in order to remove only the drum magazine 6, it is only necessary to displace the slide release 16 rearwardly in order to retract the lip 111 thereof from its overlying engagement with the magazine cover flange; however, it is impossible at this point to remove the feed block since the bottom portions of the two forward tongues 109 of the receiver cover are engaging the top of the feed block. Thus, it will be seen that it is necessary to remove the receiver cover before further disassembly of the machine gun may occur. This removal of the receiver cover is readily achieved following removal of the drum magazine from the machine gun merely by sliding the cover forwardly to displace the notch 108 on the cover central depending body section 106 from its engagement surrounding the catch pin 112 straddling the area between the two upstanding portions of the receiver main body side walls 53—53 whereupon the entire receiver cover 17 may be lifted from the receiver main body 50. At this stage, the feed block may be lifted upwardly from its confinement within the notched area 26 to disengage the alignment pins 113 upstanding from the bottom of the notched area and which are adapted to engage corresponding openings through the bottom of the feed back. It will be readily apparent that the bolt 22 may be easily removed from within the confines of the receiver at this point.

What is claimed is:

1. A machine gun for cartridges having rims with a diameter greater than the body of the cartridges including, a receiver having a reciprocating bolt and provided with an upwardly facing cartridge feeding access area adjacent the opening to the chamber of a barrel connected to said receiver, a feed block having a cartridge throat therethrough disposed within said access area and provided with a main body having at least a portion thereof straddling the top of said bolt when said bolt is in its forwardmost position of travel, a cartridge magazine mounted atop said gun and including a bottom facing cartridge exit overlying said feed block throat, drive means within said magazine sequentially urging cartridges under pressure through said exit to said feed block throat, fixed and displaceable stop means in said block bounding said throat for supporting in a forwardly downwardly inclined manner each cartridge being urged from said magazine exit for subsequent delivery by said bolt into said chamber, said fixed stop means including a pair of oppositely disposed ledges adjacent the rear of said throat and extending transversely into said throat to support there-atop only the rim of a cartridge, said displaceable stop means including a pair of oppositely disposed moveable flange members disposed below the plane of said fixed rim ledges each having an inwardly projecting lip normally extending only into the forward area of said throat, spring means constantly urging said lips into said throat and said spring means resists the pressure of said drive means and supports each cartridge in said inclined manner upon said lips until subsequent downward and forward delivery of said cartridge into said chamber by said bolt.

2. A machine gun according to claim 1 wherein, said feedback and stop means comprise an integral assembly removably disposed within said receiver access area.

3. A machine gun according to claim 2 wherein, said access area comprises a notch in the top of said receiver and the front and rear limits of said notch provide a close mating fit with the front and rear limits of said feed block.

4. A machine gun according to claim 2 including, alignment means projecting upwardly from the bottom of said access area and engageable within mating openings in the bottom of said feed block.

5. A machine gun according to claim 1 wherein, said magazine includes a feed tongue adjacent said cartridge exit and extending in an inclined direction above said exit, said feed block having a planar upper surface with said throat therethrough, a strip edge bounding one side of said throat and extending downwardly and away from said throat to provide a bevelled surface, and said feed tongue, strip edge and bevelled surface provide a smooth continuous surface whereby, cartridges driven by said magazine strike said tongue and are directed downwardly into said throat toward said stop means.

6. A machine gun according to claim 5 wherein, said throat is bounded on the side opposite said strip edge by a bevelled edge extending downwardly and toward said throat.

7. A machine gun according to claim 5 wherein, the rear of said throat is bounded by a transverse bevelled surface extending downwardly and forwardly.

8. A machine gun according to claim 5 including, a relieaf area adjacent the rear of said strip edge and providing the greatest transverse width of said throat adjacent the rear limit thereof.

9. A machine gun according to claim 1 wherein, said feed block includes a recess in the lower surface thereof adjacent each side of said throat, one side flange member disposed within each said recess, pivot means connecting one end of each said flange member to said feed block, and said spring means urges the opposite end of each said flange member inwardly toward said throat.

10. A machine gun according to claim 1 wherein, said feed block is provided with a cartridge nose guide defining the forwardmost limit of said throat, and said nose guide comprising a downwardly and forwardly tapered surface terminating adjacent the top of the entrance to the chamber.

11. A machine gun according to claim 1 wherein, the rear lower surface of said feed block is provided with a longitudinal notch therethrough, and the top of said bolt includes a vertical rib passable through said notch to engage the rim of a cartridge resting upon said ledges in order to drive the cartridge forwardly.

12. A machine gun according to claim 11 including, a pivotal extractor/ejector lever mounted in the lower forward portion of said bolt and adapted to engage the rim of a cartridge as driven into the chamber, and a pair of forwardly facing shoulders adjacent said feed block notch engageable by the rim of a cartridge as moved rearwardly by said bolt and extractor/ejector to urge the cartridge downwardly.

* * * * *